United States Patent [19]

Perrin et al.

[11] 3,951,588

[45] Apr. 20, 1976

[54] PROCESS FOR DYEING AND PRINTING OR OPTICAL BRIGHTENING OF CELLULOSE MATERIALS

[75] Inventors: Pierre Perrin, Basel; Arthur Schmutz; Raymond Défago, both of Riehen; Andres Schaub, Biel-Benken, all of Switzerland

[73] Assignee: Ciba-Geigy Corporation, Ardsley, N.Y.

[22] Filed: Aug. 30, 1974

[21] Appl. No.: 501,897

[30] Foreign Application Priority Data

Sept. 20, 1973 Switzerland ..... 13553/73

[52] U.S. Cl. ..... 8/1 A; 8/1 W; 8/74; 8/93; 8/173

[51] Int. Cl.[2] ..... D06P 5/02

[58] Field of Search ..... 8/74, 1 A, 1 W, 173, 8/93

[56] References Cited

UNITED STATES PATENTS

| | | | |
|---|---|---|---|
| 2,409,257 | 10/1946 | Croft et al. | 8/173 |
| 3,096,141 | 7/1963 | Bennett et al. | 8/63 |
| 3,816,069 | 6/1974 | Andrew et al. | 8/1 A |

FOREIGN PATENTS OR APPLICATIONS

| | | | |
|---|---|---|---|
| 887,437 | 1/1962 | United Kingdom | 8/63 |
| 937,182 | 9/1963 | United Kingdom | 8/63 |
| 1,060,734 | 3/1967 | United Kingdom | 8/63 |
| 1,321,314 | 6/1973 | United Kingdom | 8/63 |
| 1,502,255 | 10/1967 | France | 8/63 |
| 345,630 | 5/1960 | Switzerland | 8/63 |

*Primary Examiner*—M. J. Welsh

*Attorney, Agent, or Firm*—Joseph G. Kolodny; Edward McC. Roberts; Prabodh I. Almaula

[57] ABSTRACT

Described is a process for the semi-continuous or continuous dyeing and printing or optical brightening of cellulose materials by impregnation of the material with an aqueous liquor or printing paste containing at least one fibre-reactive dyestuff or fibre-reactive optical brightener, wherein subsequent to impregnation, fixing of the dyestuff or optical brightener is performed in a salt-free single-phase bath containing at least one alcohol and alkali and optionally water.

By this process there are obtained dyed or optically brightened cellulose materials having fastness properties equivalent to those obtained in the conventional manner. An advantage of the present process, in contrast to the usual processes, is that the waste water is not polluted by large amounts of salt.

7 Claims, No Drawings

PROCESS FOR DYEING AND PRINTING OR OPTICAL BRIGHTENING OF CELLULOSE MATERIALS

The invention relates to a process for the semicontinuous or continuous dyeing and printing or optical brightening of cellulose materials, as well as to the cellulose material dyed, printed or optically brightened by this process.

It is generally known that cellulose materials can be dyed with reactive dyestuffs and fixed by the addition of high amounts of salt. The disadvantage of this method is not only that high amounts of salt are required in the fixing process, which create a problem with regard to waste liquor, but also that these high amounts of salt render difficult the subsequent washing out of the reactive dyestuff not chemically bound.

A process has now been found which enables reactive dyestuffs and reactive optical brighteners to be fixed on cellulose materials without the addition of salt by impregnation or printing of these materials with a liquor or printing paste containing at least one such dyestuff or optical brightener, and the subsequent fixing of the dyestuff or optical brightener in a single-phase bath containing at least one alcohol and alkali.

Suitable reactive dyestuffs for the process according to the invention are anionic water-soluble dyestuffs of which the anionic character is determined by metal-complex formation and/or by substituents producing water-solubility. Such substituents effecting water-solubility are carboxylic acid groups, phosphoric acid groups, acylated sulphonic acid imide groups, such as alkyl- or aryldisulphimide groups or alkyl- or arylcarbonylsulphimide groups, and, in particular, sulphonic acid groups. Specially good results are in general obtained with dyestuffs containing at least one sulphonic acid group.

The reactive dyestuffs can belong to the most diverse classes of dyestuffs; they are, for example, oxazine, triphenylmethane, xanthene, nitro, acidone, stilbene, perinone, naphthoquinonimine and phthalocyanine dyestuffs, particularly, however, anthraquinone and azo dyestuffs. The last-mentioned can be metal-free, metallisable or metal-containing mono-, dis- and polyazo dyestuffs, wherein the metal atom forms a 1:1- or 1:2-complex, especially a 1:2-chromium complex or 1:2-cobalt complex, which contain two identical or two different molecules of azo dyestuff bound in complex linkage with a chromium or cobalt atom, as well as formazan dyestuffs.

These dyestuffs contain in the molecule fibre-reactive groupings which are capable of forming with the cellulose material a covalent bond. These fibre-reactive groupings can be bound directly or by way of bridge members, such as oxygen, sulphur, an imino, methyleneimino, carbonylimino, sulphonylimino or urea bridge, to the chromophoric structure of the dyestuff, preferably to an aromatic ring.

Examples of such fibre-reactive groupings are: the radical of an acid containing at least one reactive halogen atom and/or a multiple bond capable of addition, e.g. chloro- or bromoacetic acid, β-chloro- and β-bromopropionic acid, α,β-dibromopropionic acid, tetrahalocyclobutanecarboxylic acid, such as 2-chloro-2-fluoro-3,3-difluoro- or 2,2,3,3-tetrafluoro-cyclobutane-1-carboxylic acid, propiolic acid, acrylic acid, methacrylic acid, α-chloro-, β-chloro- α-bromo- and β-bromoacrylic acid, α,β- and β,β-dichloro- or -dibromoacrylic acid, trichloro- or tribromoacrylic acid, 2-(2,2,3,3-tetrafluorocyclobutyl-1)-acrylic acid, crotonic acid, α- or β-chloro- or -bromocrotonic acid, α,β-dichlorocrotonic acid, maleic acid, monochloro- and monobromomaleic acid, dichloro- and dibromomaleic acid, fumaric acid, monochloro- and monobromofumaric acid, dichloro- and dibromofumaric acid, fumaric acid monoester, dichloro- and dibromosuccinic acid, vinylsulphonic acid, β-chlorovinylsulphonic acid or of a nitrohalobenzoic acid or nitrohalobenzenesulphonic acid having a reactive halogen atom, especially fluorine or chlorine, in the o- or p-position with respect to the nitro group, such as the radical of 3-nitro-4-fluorobenzoic acid or 3-nitro-4-fluorobenzenesulphonic acid; also 3-methylsulphonyl-4-fluorobenzoic acid or 2 -methylsulphonyl-5-fluoro-4-benzoic acid, as well as β-hydroxyalkylsulphonyl, -sulphamoyl, -sulphonamido or -carbonamido groups esterified with strong acids, such as the β-haloethylsulphonyl, β-sulphatoethylsulphonyl, β-sulphatoethylsulphamoyl, β-sulphatoethyl-N-methylsulphonamido or β-sulphatopropionamido group, the β-alkyl- or β-phenylsulphonylalkyl-sulphonyl-, -sulphonamido or -carbonamido group, e.g. the β-phenylsulphonylpropionamido group. Also suitable are: the radical of an aromatic nitrogen heterocycle having advantageously more than one ring hetero atom, which contains at least one reactive halogen atom such as fluorine, chlorine or bromine, or an ammonium group or sulphonic acid group or alkylsulphonyl group on a ring carbon atom. Mentioned as examples of such reactive groups are: the triazinyl radical having at least one reactive halogen atom, e.g. the radical of cyanuric chloride, cyanuric bromide or primary condensation products thereof, in which a halogen atom is replaced by the optionally further substituted radical of a primary or secondary aliphatic, alicyclic, aromatic or heterocyclic amine, particularly by aniline or its alkyl and sulphonic acid or carboxylic acid derivatives, by lower mono- and dialkylamines, as well as by ammonia, or by the radical of an aliphatic, alicyclic, aromatic or heterocyclic hydroxy or thiol compound. Of interest in this connection are also monochlorotriazines to which is bound the radical of an alcohol and advantageously of an etherified dialcohol, and which correspond to the general formula

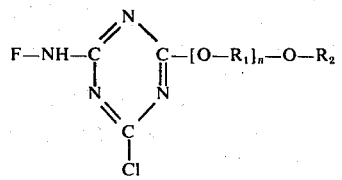

wherein

F represents the radical of a dyestuff, $R_1$ represents an alkylene radical, and $R_2$ represents an alkyl radical, and n is 0 or 1.

The radicals $R_1$ and $R_2$ can be straight-chain or branched-chain.

Also mentioned is the diazinyl radical, such as the di- or trihalopyrimidyl radical, e.g. the 2,4-di- or, in particular, 2,4,5-trichloro-, -bromo-, -fluoro-, 5-bromo- or 5-chloro-2,4-difluoro- or 5-bromo-2,4dichloropyrimidyl-6 radical. The dihalopyrimidyl radical can carry in the 5-position, for example, also the following substituents: methyl, ethyl, nitro, cyano, carboxylic acid amide or sulphonic acid amide optionally substituted on the nitrogen atom, carboxylic acid methyl ester or carboxylic acid ethyl ester, acyl, e.g. benzoyl, alkenyl, e.g. allyl, chlorovinyl, substituted alkyl, e.g. carboxymethyl, chloro- or bromomethyl.

Further suitable nitrogen heterocycles are, e.g. the radical of a dihalopyrimidinecarboxylic acid, 2,3-dihaloquinoxalinecarboxylic acid or -sulphonic acid, 2-halo- or 2-methylsulphonyl-benzothiazole- or -oxazolecarboxylic acid or -sulphonic acid, 1,4-dihalophthalazinecarboxylic acid, 2,4-dihaloquinazolinecarboxylic acid or 4,5-dihalo-6-pyridazon-1-yl-alkyleneor -phenylenecarboxylic acid, such as the acid radicals of 2,4-difluoro- or 2,4-dichloropyrimidine-5- or -6-carboxylic acid, 2,4-dichloro-6-chloromethylpyrimidine-5-carboxylic acid, 2,3-difluoro- or 2,3-dichloroquinoxaline-6-carboxylic acid or -6-sulphonic acid, 2-chlorobenzothiazole- or -oxazole-5- or -6-carboxylic acid or -5- or -6-sulphonic acid, 1,4-difluoro-, 1,4-dichloro- or 1,4-dibromophthalazine-6-carboxylic acid or -6-sulphonic acid, 2,4-dichloro-quinazoline-6- or -7-carboxylic acid, 2,3-dichloro-quinoxaline-7-carboxylic acid or -7-sulphonic acid, 4,5-dichloro-6-pyridazon-1-yl-trimethylenecarboxylic acid or -1′,4′-phenylene-carboxylic acid.

Suitable also are the radicals: trichloropyridazinyl, dichloro-1,2,4-triazinyl, 3-chloro-pyridazine-6-carboxylic acid, 5-chloro-1,2,4-thiadiazol-3-yl-1′,4′-phenylene-carboxylic acid, allylsulphone and allylsulphide. Also to be mentioned are reactive "onium dyestuffs" which contain, e.g. instead of a reactive halogen atom or an ester group, a reactive ammonium quinuclidinium, pyridinium, hydrazinium or sulphonium radical.

The amount of dyestuffs added to the liquor in the process according to the invention is governed by the desired depth of colour.

As mentioned, the process according to the invention is suitable also for the optical brightening of undyed cellulose materials with water-soluble, especially anionic, reactive optical brighteners. These can belong to any desired classes of brighteners. In particular they are stilbene compounds, coumarins, benzocoumarins, pyrazines, pyrazolines, oxazines, dibenzoxazolyl or dibenzimidazolyl compounds as well as naphthalic acid imides, which contain in the molecule at least one fibre-reactive grouping as defined.

All the said dyestuffs and optical brighteners are known and can be prepared by known methods.

The dyeing or brightener impregnating liquor or the printing paste contains water and can, in addition, contain the additives common in dyeing, such as, e.g. acids and bases, as well as the agents improving solubility and diffusion, such as urea. It is however possible to also add to the liquor compounds which accelerate the reaction between dyestuff and fibre, such as tertiary amines or hydrazine compounds having at least one tertiary nitrogen atom. The result of this is, for example, that the reaction temperatures or the reaction times can be decreased and/or more deeply coloured dyeings obtained. Further suitable additives are agents which prevent decomposition of the dyestuff.

Furthermore, the usual electrolytes (sodium chloride or sodium sulphate) may be added.

It is also possible if desired to add to the impregnating liquor alcohols in such amounts that the dyestuff or optical brightener as defined does not precipitate.

With application of a printing paste, it is clear that this can contain the usual thickening agents.

After the impregnating or printing operation, which operations are preferably performed at room temperature, the treated material can be intermediately dried before the fixing process, for example, with air at 100°C.

The fixing process is subsequently performed by treatment of the material, optionally intermediately dried, in a salt-free single-phase bath containing at least one alcohol and alkali and, optionally, water.

The alcohols used in this process must be of such a nature that they do not dissolve the dyestuff, or at least dissolve it less than water, and they must in addition be miscible with water to the extent that with this there is formed, in the range of application, a single-phase system. Alcohols having these properties are, in particular, aliphatic alcohols such as ethyl alcohol, n- and isopropyl alcohol, tert.-butyl alcohol and 2,5-hexanediol, or araliphatic alcohols such as benzyl alcohol. The preferred alcohol is isopropyl alcohol.

It is however also possible to use mixtures of such alcohols, such as, e.g. a mixture of n-butyl alcohol and isopropyl alcohol.

Suitable alkalies for use are, in particular, sodium hydroxide solution, sodium carbonate and sodium bicarbonate. The alkali can be introduced into the fixing liquor by way of the impregnating liquor, or it can be advantageously added directly to the fixing liquor.

The duration of the fixing process is dependent on various factors, such as, e.g. on the reactivity of the dyestuff or of the optical brightener, on the alkalinity of the bath and on the temperature. Highly reactive dyestuffs are fixed, e.g. for about 10 seconds at temperatures up to about 70°C, while normal reactive dyestuffs or reactive optical brighteners are fixed for about 30 to 60 minutes at about 70°C. It is however also possible to fix the material, moist with fixing liquor, by storing it for about 1 to 40 hours at room temperature.

Finishing is subsequently performed by firstly removing the fixing liquor, and then rinsing and optionally soaping the material.

A modification of the process according to the invention consists in carrying out the impregnating and fixing processes in one stage, i.e. there are added to the aqueous salt-free impregnating liquor, in addition to the reactive dyestuff or reactive optical brightener, alkali and the alcohol as defined, and the material thus impregnated is subsequently stored, for fixing of the dyestuff or optical brightener, preferably for about 1 to 40 hours at room temperature, and then finished.

Suitable cellulose material is, in particular, that made from natural cellulose, such as cotton, hemp, linen, jute, ramie, or regenerated cellulose, such as viscose cellulose or cuprammonium rayon, or also fibre mixtures, such as, e.g. a mixture of cellulose and polyester, with the polyester part being optionally dyed preliminarily or subsequently.

This fibre material can be in any stage of processing, for example, as loose material (combed material), or it can be in the form of filaments, yarns, fabrics or knitwear.

By this process there are obtained dyed or optically brightened cellulose materials having fastness properties equivalent to those obtained in the conventional manner.

The following examples illustrate the invention, without its scope being in any way limited by them. The temperature values are expressed in degrees Centigrade. The employed dyestuffs and optical brighteners are used in their usual commercial forms.

EXAMPLE 1

30 g of the yellow dyestuff of the formula

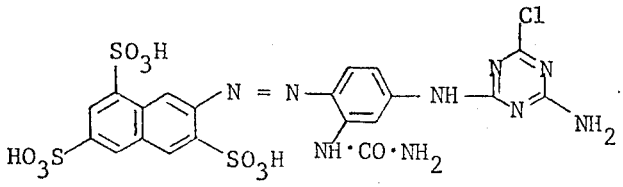

is dissolved in one liter of water at boiling temperature. After cooling of the solution, it is used to impregnate a mercerised cotton fabric in such a manner that a weight increase of 80% is obtained. Without being intermediately dried, the fabric is thereupon treated in a liquor consisting of 8 parts of 0.1N sodium hydroxide solution, 2 parts of water and 90 parts of isopropyl alcohol for 45 minutes at 70°, with a ratio of goods to liquor of 1:20. After being rinsed in cold and in warm water, the fabric is washed for 10 minutes in boiling water, rinsed clear and then dried.

There is obtained a strongly coloured, deep, level, gold-yellow cotton dyeing having good fastness to light and to washing and a good fixing value of the dyestuff.

If non-mercerised cotton or spun-rayon fabric is used instead of mercerised cotton fabric, with the procedure being otherwise as described in the example, then there are likewise obtained fast, deep, gold-yellow dyeings.

If, instead of the dyestuff of the above constitution, identical amounts of the optical brightener of the formula

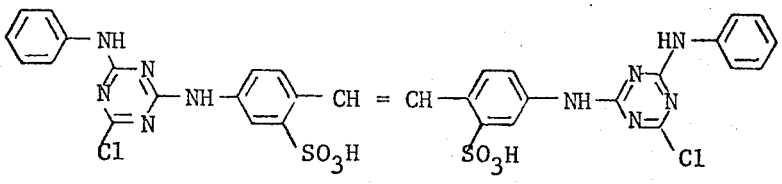

are used, the procedure otherwise being the same, then a very well brightened cotton fabric is obtained.

EXAMPLE 2

30 g of the red dyestuff of the formula

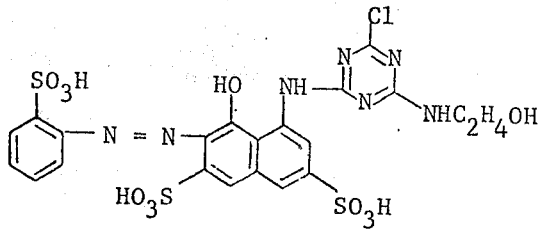

is dissolved in one liter of water at boiling temperature. After cooling of the solution, there is added 5 ml of 30% aqueous sodium hydroxide solution, and a cotton fabric is impregnated therewith. The fabric is then squeezed out on a padding machine to 100% increase in weight, and subsequently treated, to effect fixing of the dyestuff, in benzyl alcohol for 45 minutes at 70°. The material is afterwards rinsed cold and warm, washed at boiling temperature with water for 10 minutes, rinsed and dried.

A deeply coloured, level, wash- and light-fast, red cotton dyeing is obtained.

If, instead of cotton fabric, a fabric made from linen or viscose cellulose is used, then an equally well dyed material is obtained.

EXAMPLE 3

30 g of the blue dyestuff of the formula

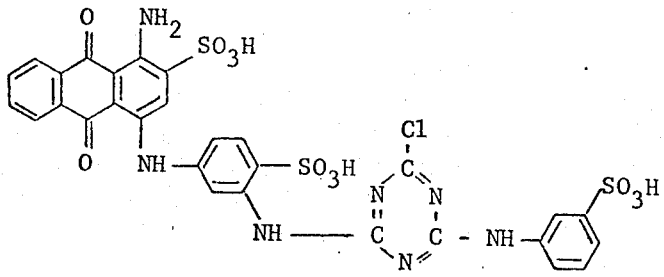

is dissolved in one liter of water. A cotton fabric is impregnated with this solution to the extent that a weight increase of 100% results. After an intermediate drying, the fabric is treated in a liquor consisting of 8 parts of 0.1N sodium hydroxide solution, 12 parts of water and 80 parts of isopropyl alcohol for 45 minutes at 70°, with a ratio of goods to liquor of 1:20. The fabric is subsequently washed out with cold water and boiling water, and then dried.

The result is a deeply-coloured, level blue dyeing having fastness to washing and to light.

If, instead of cotton fabric, a fabric made from linen or from viscose fibres is used, then an equally good dyeing is obtained.

EXAMPLE 4

30 g of the yellow dyestuff of the formula

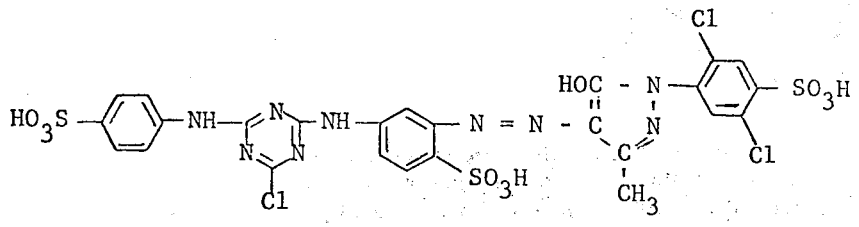

is dissolved in one liter of water at boiling temperature. After cooling of the solution, an addition is made to it of 5 ml of 30% aqueous sodium hydroxide solution, and a cotton fabric is padded therewith on a padding machine; the fabric is then squeezed out to 75% increase in weight and dried with air at 100°. The fabric thus prepared is treated in isopropyl alcohol for 45 minutes at 70°. It is subsequently washed cold and warm with water, and then dried.

The result is a deeply-coloured, level yellow cotton dyeing having fastness to washing and to light.

Linen and viscose cellulose can be dyed in the same manner.

EXAMPLE 5

30 g of the red dyestuff of the formula

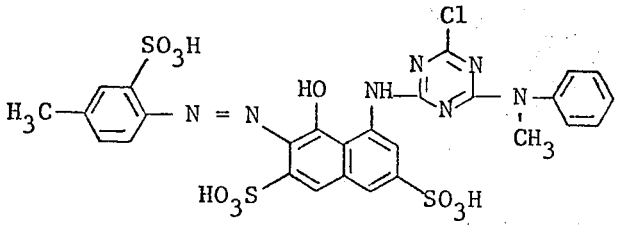

is dissolved in 900 ml of boiling water. After cooling of the solution, an addition is made to it of 100 ml of isopropyl alcohol. A cotton fabric is impregnated with this solution on a padding machine, and then squeezed out to 100% weight increase. Without intermediate drying, the fabric is treated with a liquor consisting of 8 parts of 0.1N sodium hydroxide solution, 2 parts of water and 90 parts of isopropyl alcohol for 45 minutes at 70°, with a ratio of goods to liquor of 1:20. The fabric is afterwards rinsed with water, washed and dried.

There is obtained a deep red cotton dyeing having good fastness to light and to washing.

Good results are likewise obtained with linen or with regenerated cellulose fibres.

EXAMPLE 6

30 g of the dyestuff according to Example 2 is dissolved in one liter of warm water. The solution is cooled, and a mercerised cotton fabric is padded therewith to give an increase in weight of 70%. Without being intermediately dried, the fabric is treated with a solution of 0.6 ml of 30% sodium hydroxide solution per liter in 96% ethyl alcohol, with a ratio of goods to liquor of 1:20, firstly at 20° for 10 minutes and then at 70° for 30 minutes. The material is subsequently washed cold and then warm with water.

The result is a strong red dyeing having good fastness to wet processing and to light.

If, instead, the ethyl alcohol, identical amounts of tert.butanol or 2,5-hexanediol are used, with otherwise the same procedure, then an equally good dyeing is obtained.

EXAMPLE 7

30 g of the yellow dyestuff of the formula

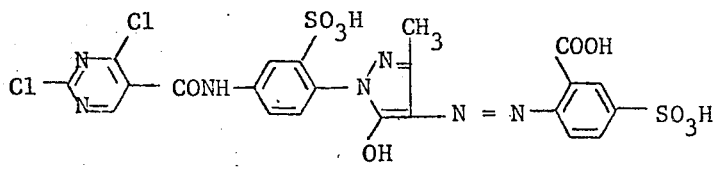

is dissolved in one liter of water. A cotton fabric is impregnated with this solution in such a manner that an increase in weight of 80% results.

After an intermediate drying, the fabric is passed for 15 seconds through a cold solution which is obtained by dissolving 10 ml of 30% aqueous sodium hydroxide solution in 200 ml of water, and adding 800 ml of isopropyl alcohol. After removal from the bath, the fabric is rinsed cold and then for 10 minutes in boiling water and finally dried.

The result is a strong yellow dyeing having good fastness properties.

If, instead of the dyestuff of the above constitution, there is used one of the dyestuffs listed in the following table, with otherwise the same procedure, then dyeings in the shades given in the last column are obtained on cotton fabric.

TABLE I

| Ex. | Dyestuff | Shade |
|---|---|---|
| 8 | 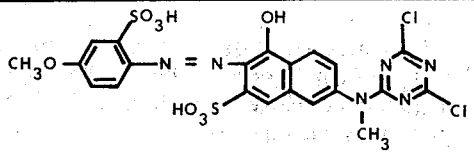 | red |
| 9 | 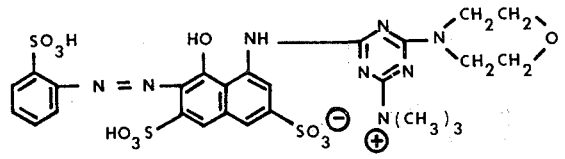 | red |

EXAMPLE 10

30 g of the dyestuff of the formula

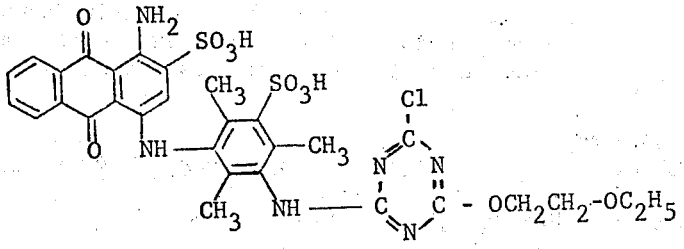

is dissolved in warm water. After cooling of the solution, it is used to impregnate a mercerised cotton fabric in such a manner that an increase in weight of 70% is obtained. After an intermediate drying, the cotton fabric is again impregnated, this time with a solution obtained by mixing together 10 ml of 30% aqueous sodium hydroxide solution, 200 ml of water and 800 ml of isopropyl alcohol. The fabric is then rolled up, packed into a polyethylene sheet and left to stand for 12 hours at room temperature. After being rinsed in cold water and in warm water, the fabric is dried.

There is obtained a brilliant blue dyeing having good fastness to light and to wet processing.

If, instead of the dyestuff of the above formula, those in the following Table II are used, with otherwise the same procedure, then there are obtained on cotton fabric the shades shown in the last column.

TABLE II

| Ex. | Dyestuff | Shade |
|---|---|---|
| 11 | 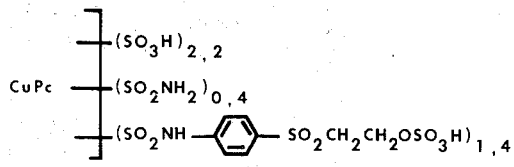 | turquoise blue |
| 12 | 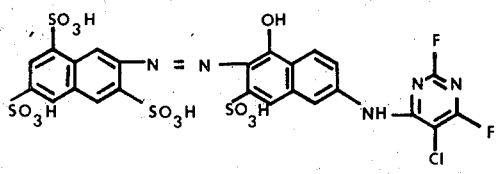 | scarlet |

EXAMPLE 13

40 g of the blue dyestuff according to Example 3 is dissolved in 270 ml of water by boiling for a short time. After cooling of the solution, an addition is made to it of 700 ml of isopropyl alcohol and 8 ml of 30% aqueous sodium hydroxide solution. A bleached cotton fabric is impregnated therewith on a padding machine; the fabric is then squeezed out to 75% increase in weight and rolled up: the roll is wrapped in a plastic sheet and allowed to stand for 24 hours at room temperature. The fabric is firstly rinsed in cold water and afterwards in boiling water for 10 minutes and dried.

The result is a level, deep, blue dyeing having good fastness to washing and to light.

If, instead of cotton fabric, a linen or spun-rayon fabric is used, then good results are likewise obtained.

EXAMPLE 14

A fabric made from bleached and mercerised cotton is printed by screen printing with a printing paste of the following composition:

30 g of the red dyestuff of the formula

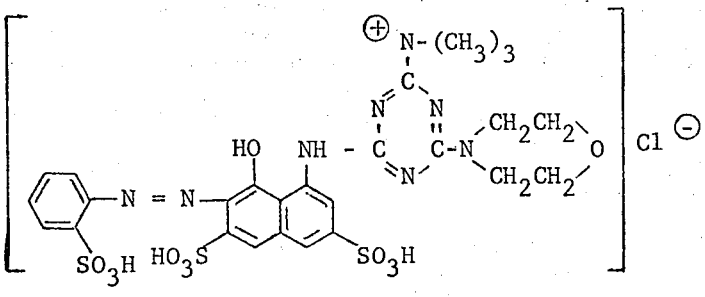

is dissolved in 240 g of water with
200 g of urea
30 g of sodium bicarbonate and
500 g of an aqueous solution of sodium alginate (5%).

The fabric is subsequently dried, and treated, to effect fixing, in a solution of 4 parts of isopropyl alcohol in 1 part of water for 10 seconds at 70°, and then washed first in cold water, then in boiling water and again in cold water.

The result is a sharply outlined print in a deep, brilliant red shade.

If, instead of cotton fabric, there is used a fabric made from viscose cellulose, cotton not mercerised or linen, then similarly good prints are obtained.

If, instead of the red dyestuff in the above printing paste, there is used the red dyestuff of the formula

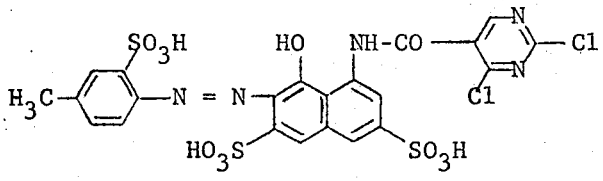

with otherwise the same procedure, then an equally good print is obtained.

EXAMPLE 15

A fabric made from mercerised cotton, pretreated in the usual manner for printing, is printed by roller printing with the following printing paste:

30 g of the dyestuff according to Example 14 is dissolved in 500 g of water, and thickened with a 5% solution of sodium alginate in water to give a printable paste. Directly after printing, the fabric is passed for a duration of 10 seconds through a solution at 70° consisting of 800 parts of isopropyl alcohol,
185 parts of water and
15 parts of sodium hydroxide solution 36°Be.

The subsequent washing operation is performed in cold water, then in boiling water and again in cold water.

The result is a deeply coloured printing in a brilliant red shade.

If an intermediate drying is inserted between printing and the fixing process, the procedure otherwise being as described above, then there is likewise obtained a printing of high quality.

EXAMPLE 16

If the procedure as given in Example 15 is followed except that, instead of the red dyestuff employed there, there is used such a dyestuff of the formula

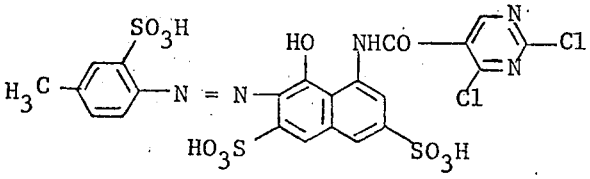

with otherwise the same procedure, then an equally good result is obtained.

EXAMPLE 17

A fabric made from mercerised cotton, pretreated in the usual manner for printing, is printed by roller printing with the following printing paste:

30 g of the dyestuff according to Example 16 is dissolved in 500 g of water, and thickened with a 5% solution of sodium alginate in water to give a paste capable of printing. The printed fabric is subsequently dried, and afterwards treated for 10 seconds with a solution at 70° consisting of 800 parts of isopropyl alcohol, 185 parts of water and 15 parts of sodium hydroxide solution 36°Be. The fabric is then washed cold, boiling and again cold; the result is a deeply coloured printing in a red shade.

EXAMPLE 18

A knitted fabric, consisting of absorbent, pretreated, leached cotton, is printed with a printing paste of the following composition:

30 g of the red dyestuff of the formula

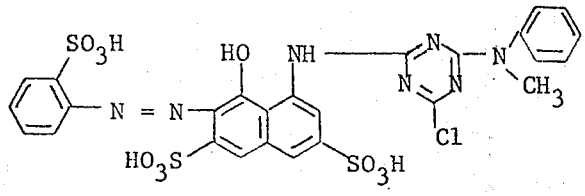

dissolved in 500 g of water, and thicked with 470 g of a 5% aqueous solution of sodium alginate. After being printed and dried, the knitted fabric is impregnated on a padding machine with a cold solution of 800 parts of isopropyl alcohol in 185 parts of water and 15 parts of sodium hydroxide solution 36°Be, in such a manner that a 100% increase in weight results.

The knitted fabric thus prepared is stored with the exclusion of air for 12 hours, and subsequently washed out in water. The result is a printing with a remarkable dye yield and high brilliance.

If, instead of the dyestuff of the above formula, there is used the dyestuff according to Example 14, and the knitted fabric stored, with the exclusion of air, not for 12 hours but for only 5 hours, with otherwise the same procedure, then an equally good printing is obtained.

We claim:

1. Process for the semi-continuous or continuous dyeing and printing or optical brightening of cellulose materials by impregnation of the material with an aqueous liquor or printing paste containing at least one fibre-reactive dyestuff or fibre-reactive optical brightener, wherein, subsequent to impregnation, fixing of the dyestuff or optical brightener is performed in a single-phase bath containing at least one alcohol and alkali.

2. Process according to claim 1, wherein the material is intermediately dried after impregnation and before the fixing process.

3. Process according to claim 1, wherein the fixing process is performed in a single-phase alkaline bath containing, as alcohol, an aliphatic alcohol or araliphatic alcohol.

4. Process according to claim 3, wherein the aliphatic alcohol used is ethyl alcohol, n-propyl alcohol, isopropyl alcohol, tert.butyl alcohol or 2,5-hexanediol, and the araliphatic alcohol used is benzyl alcohol.

5. Process according to claim 3, wherein the fixing process is performed in a single-phase alkaline bath containing, as aliphatic alcohol, isopropyl alcohol.

6. Modification of the process according to claim 1, wherein the impregnating and fixing processes are performed in one stage from an aqueous alkaline bath containing alcohol.

7. The cellulose material dyed and printed or optically brightened according to the process of claim 1.

* * * * *